US011428453B2

(12) United States Patent
Jung et al.

(10) Patent No.: US 11,428,453 B2
(45) Date of Patent: Aug. 30, 2022

(54) REFRIGERATOR HAVING HIGH FREQUENCY WAVE THAWING DEVICE

(71) Applicant: Samsung Electronics Co., Ltd., Suwon-si (KR)

(72) Inventors: Moongyo Jung, Suwon-si (KR); Youngheon Kim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 117 days.

(21) Appl. No.: 16/957,884

(22) PCT Filed: Dec. 19, 2018

(86) PCT No.: PCT/KR2018/016266

§ 371 (c)(1),
(2) Date: Jun. 25, 2020

(87) PCT Pub. No.: WO2019/132401

PCT Pub. Date: Jul. 4, 2019

(65) Prior Publication Data

US 2020/0318885 A1 Oct. 8, 2020

(30) Foreign Application Priority Data

Dec. 27, 2017 (KR) ..... 10-2017-0180756
Aug. 30, 2018 (KR) ..... 10-2018-0102655

(51) Int. Cl.
*F25C 5/08* (2006.01)

(52) U.S. Cl.
CPC ..... *F25C 5/08* (2013.01); *F25C 2600/04* (2013.01)

(58) Field of Classification Search
CPC ..... F25C 5/08; F25C 2600/04; F25D 23/12; F25D 11/02; F25D 23/028; F25D 23/069; F25D 29/00; H05B 6/688
See application file for complete search history.

(56) References Cited

U.S. PATENT DOCUMENTS

2013/0276465 A1* 10/2013 Shin ..... F25D 17/065 62/3.6

FOREIGN PATENT DOCUMENTS

JP 62-147280 7/1987
JP S63049674 A * 3/1988 ..... F25B 49/00
(Continued)

OTHER PUBLICATIONS

JP-63231191-A translation (Year: 1988).*
(Continued)

*Primary Examiner* — Elizabeth J Martin
*Assistant Examiner* — Samba N M N Gaye
(74) *Attorney, Agent, or Firm* — Staas & Halsey LLP

(57) ABSTRACT

A refrigerator having a thawing function includes: a freezer chamber having a thawing chamber; an evaporator configured to generate a cold air through a heat exchange; a circulation fan configured to transmit, to the freezer chamber, the cold air generated by the evaporator; a high frequency wave generator provided at one side of the thawing chamber to generate high frequency waves in order to thaw a material to be thawed accommodated in the thawing chamber; a heat absorber configured to come in thermal contact with the high frequency wave generator to absorb heat from the high frequency wave generator; and a heat conduction member connected between the heat absorber and the evaporator to transfer heat from the heat absorber to the evaporator.

15 Claims, 17 Drawing Sheets

(56) References Cited

FOREIGN PATENT DOCUMENTS

| | | | | | |
|---|---|---|---|---|---|
| JP | 63231191 | A | * | 9/1988 | |
| JP | 63-49674 | | | 12/1988 | |
| JP | 6-147726 | | | 5/1994 | |
| KR | 10-2005-0110230 | | | 11/2005 | |
| KR | 10-0600375 | | | 7/2006 | |
| KR | 10-2009-0119100 | | | 11/2009 | |
| KR | 10-2013-0060462 | | | 6/2013 | |
| KR | 10-1768724 | | | 8/2017 | |
| KR | 101768724 | B1 | * | 8/2017 | ..... F25B 21/02 |

OTHER PUBLICATIONS

JP-63049674-A translation (Year: 1988).*
KR-101768724-B1 (Year: 2017).*
International Search Report dated Apr. 9, 2019 from International Application No. PCT/KR2018/016266, 4 pages.

* cited by examiner

REFRIGERATOR HAVING HIGH FREQUENCY WAVE THAWING DEVICE

CROSS-REFERENCE TO RELATED APPLICATIONS

This application is a U.S. National Stage Application which claims the benefit under 35 U.S.C. § 371 of International Patent Application No. PCT/KR2018/016266 filed on Dec. 19, 2018, which claims foreign priority benefit under 35 U.S.C. § 119 of Korean Patent Application Nos. 10-2017-0180756 filed on Dec. 27, 2017 and 10-2018-0102655 filed on Aug. 30, 2018 in the Korean Intellectual Property Office, the contents of each of which are incorporated herein by reference.

TECHNICAL FIELD

Apparatuses consistent with embodiments relate to a refrigerator, which provides a function capable of thawing a material to be thawed by using high frequency waves.

BACKGROUND ART

Generally, to thaw a frozen food quickly, a microwave oven is mainly used. Users take out the frozen food stored in a freezer chamber of a refrigerator therefrom, move it to the microwave oven, and then thaws it using a thawing function in the microwave oven.

At this time, to thaw the frozen food, if naturally thawing the frozen food in a cool chamber of the refrigerator or in a room temperature for a given time and then thawing the frozen food using the microwave oven, it may reduce a certain amount of time and power for the microwave oven to thaw the frozen food.

However, to thaw the frozen food, taking it out from the freezer chamber to move to the microwave oven, or moving it to the microwave oven to thaw it after naturally thawing it in the cool chamber or in the room temperature may be somewhat cumbersome.

Also, in a market situation where a consumption of the frozen foods is increasing, it is required to provide faster and convenient thawing function to the users.

In accordance with to this demand, in recent, techniques that the refrigerators are provided with a thawing chamber corresponding to the function of the microwave oven in the freezer chamber to provide a thawing function are being introduced.

However, since these prior art refrigerators have only a function of merely applying heat in the freezer chamber, it may be difficult to properly maintain a temperature in the freezer chamber due to heat generated when thawing the frozen food using high frequency waves in the freezer chamber. Further, due to this, the food stored in the freezer chamber may not be maintained in a frozen state of constant temperature, but spoiled. Also, in the prior art refrigerators, the heat generated when thawing the frozen food may have a bad influence on a thawing device, thereby degrading a performance of the thawing device.

DISCLOSURE

Technical Problem

Embodiments provide a refrigerator, which can prevent a performance of high frequency wave thawing device from being degraded due to heat generated in thawing as well as providing fast and convenient thawing function to users.

Also, Embodiments provide a refrigerator having a high frequency wave thawing device, which can prevent food stored in a freezer chamber from being spoiled due to heat generated when thawing the food using high frequency waves.

Technical Solution

According to an embodiment, a refrigerator includes: a freezer chamber having a thawing chamber; an evaporator configured to generate a cold air through a heat exchange; a circulation fan configured to transmit, to the freezer chamber, the cold air generated by the evaporator; a high frequency wave generator provided at one side of the thawing chamber to generate high frequency waves in order to thaw a material to be thawed accommodated in the thawing chamber; a heat absorber configured to come in thermal contact with the high frequency wave generator to absorb a heat from the high frequency wave generator; and a heat conduction member connected between the heat absorber and the evaporator to transfer a heat from the heat absorber to the evaporator.

The refrigerator according to an embodiment may prevent food stored in the freezer chamber from being spoiled due to the heat generated when thawing by using the high frequency waves and prevent the performance form being degraded due to the heat of the high frequency wave thawing device.

The refrigerator may further include a heat sink attached to the high frequency wave generator to absorb a heat generated when the high frequency wave generator generates the high frequency waves, between the high frequency wave generator and the heat absorber. Accordingly, the heat sink may absorb the heat generated in the high frequency wave generator when thawing by using high frequency waves, thereby preventing the high frequency wave generator from being overheated.

The heat absorber may include a radiation plate detachably attached to the heat sink, and a radiation plate casing and a radiation plate cover configured to accommodate the radiation plate therein, and the radiation plate may be configured to radiate a heat transferred from the heat sink. Accordingly, the heat absorber may provide a construction for efficiently radiating the heat generated in the high frequency wave generator when thawing by using the high frequency waves.

The radiation plate casing and the radiation plate cover may include an insulation member to prevent the radiation plate from exchanging a heat with the freezer chamber. Accordingly, when the heat generated in the high frequency wave generator is radiated, the radiation plate casing and the radiation plate cover may provide a heat insulation function, which prevents the radiated heat from being transferred to the freezer chamber.

The refrigerator may further include a device room provided with the high frequency wave generator therein, and the device room may include an insulation member to prevent from exchanging a heat with the freezer chamber. Accordingly, the device room may provide a heat insulation function, which prevents the heat generated in the high frequency wave generator when thawing by using the high frequency waves from being transferred to the freezer chamber.

The high frequency wave generator may include: a power supply configured to supply power; a radio frequency (RF)

generator configured to generate the high frequency waves for thawing the material to be thawed accommodated in the thawing chamber; and a processor configured to control an operation for thawing according to characteristics of the material to be thawed. Accordingly, the refrigerator may conveniently thaw the material to be thawed accommodated in the freezer chamber without moving it to an outside thereof, a microwave oven for thawing it or the like.

The processor may be configured to receive a user input through a user interface and control to carry out an operation for thawing corresponding to the received user input. Accordingly, the refrigerator may thaw the material to be thawed accommodated in the freezer chamber by user's simple manipulation.

The thawing chamber may include an electrode part configured to receive the high frequency waves generated in the RF generator to radiate to the material to be thawed. Accordingly, the thawing chamber may provide a configuration, which is able to radiate the high frequency waves in order to thaw the material to be thawed accommodated in the freezer chamber.

The thawing chamber may be configured to switch between a freezing mode and a low temperature thawing mode according to the user input. Accordingly, the thawing chamber is usually maintained in a frozen storing state and then when the thawing function is performed according to user's manipulation, provide the thawing function using the high frequency waves.

The freezer chamber may have a partition configured to divide a storing space for accommodating the material to be thawed and a cooling space for cooling an air therein, and the partition may be configured to form a flow passage of cold air through which the air cooled in the cooling space is transferred to the storing space. Accordingly, the cold air generated in the evaporator may be circulated through the flow passage on the outside of the partition, thereby maintaining the freezer chamber in a proper temperature.

According to another embodiment, a refrigerator includes: a freezer chamber comprising a partition configured to divide a storing space for accommodating a material to be thawed therein and a cooling space for cooling an air therein and having a thawing chamber therein; an evaporator configured to generate a cold air through a heat exchange, on an outside of the partition; a circulation fan configured to transmit, to the freezer chamber, the cold air generated by the evaporator; a high frequency wave generator provided at one side of the thawing chamber to generate high frequency waves in order to thaw a material to be thawed accommodated in the thawing chamber; and a flow passage configured to transmit the cold air of the cooling space to the high frequency wave generator and transfer an air of high frequency wave generator side to the evaporator.

The refrigerator according to another embodiment may provide a heat radiation effect, which prevents food stored in the freezer chamber from being spoiled due to the heat generated when thawing by using high frequency waves The refrigerator may further include a device room provided with the high frequency wave generator therein, the device room may include a first space configured to accommodate the high frequency wave generator therein and a second space provides to cool a heat generated in the high frequency wave generator, and the flow passage may be provided to move an air in the second space to the evaporator. Accordingly, the device room may include the flow passage, which radiates the heat generated in the high frequency wave generator when thawing by using the high frequency waves, thereby effectively radiating the generated heat.

The refrigerator may further include a heat sink attached to the high frequency wave generator to absorb a heat generated when the high frequency wave generator generates the high frequency waves in the second space. Accordingly, the heat sink may absorb the heat generated in the high frequency wave generator when thawing by using the high frequency waves, thereby preventing the high frequency wave generator from being overheated.

The device room may include an insulation member configured to prevent from exchanging a heat with the freezer chamber in the first space and the second space. Accordingly, the device room may provide a heat insulation function, which prevents the heat generated in the high frequency wave generator when thawing by using the high frequency waves from being transferred to the freezer chamber.

The flow passage may include: an incoming flow passage tube configured to provide the cold air supplied from the evaporator, to the high frequency wave generator; and an outgoing flow passage tube configured to flow out the air of high frequency wave generator side to the evaporator. Accordingly, the flow passage may be formed, so that the cold air supplied from the evaporator comes into the high frequency wave generator and the heat generated in the high frequency wave generator flows out to the evaporator, thereby effectively emitting the heat generated in the high frequency wave generator.

An inlet of the outgoing flow passage tube may be provided on a position corresponding to the high frequency wave generator. Accordingly, the heat generated in the high frequency wave generator may be instantly emitted to the evaporator via the flow passage.

The incoming flow passage tube may be provided higher than the outgoing flow passage tube.

An inlet of the incoming flow passage tube may be provided on an upper portion of the evaporator, and an outlet of the outgoing flow passage may be provided on a lower portion of the evaporator. Accordingly, the flow passage may be configured, so that the heat generated in the high frequency wave generator is emitted to the evaporator via a lower end of the device room in which the high frequency wave generator is provided and the cold air generated while passing through the evaporator comes into an upper end of the device room, thereby preventing the inside of the device room from being overheated.

The cold air of the evaporator may be circulated from a lower portion to an upper portion of the cooling space in the cooling space and an air, which absorbs the heat in the high frequency wave generator and then discharged into a lower portion of the partition, may be join an air moving to the evaporator for the purpose of freezing. Accordingly, apart from the flow passage emitting the heat generated in the high frequency wave generator when thawing by using the high frequency waves, the cold air may be continually supplied to the freezer chamber to properly maintain the temperature therein.

The partition may include a circulation passage through which the cold air cooled in the cooling space flows therein, and the circulation passage may form an air outlet through which the cooling air is discharged to the incoming flow passage tube. Accordingly, the cold air generated in the evaporator may cool the heat generated in the high frequency wave generator.

Advantages Effects

As described above, according to the embodiments, the refrigerator has an effect, which provide fast and convenient thawing function to users.

Also, the refrigerator may prevent the food stored in the freezer chamber from being spoiled due to the heat generated when the thawing function is carried out using the high frequency waves.

Also, the refrigerator may prevent the performance from being degraded due to the heat generated when the thawing function is carried out using the high frequency waves.

BEST MODE

Below, embodiments will be described in detail with reference to accompanying drawings for those skilled in the art to work the present disclosure without difficulty. The embodiments may be achieved in various forms, and are not limited to the embodiments provided herein.

Figure 1:
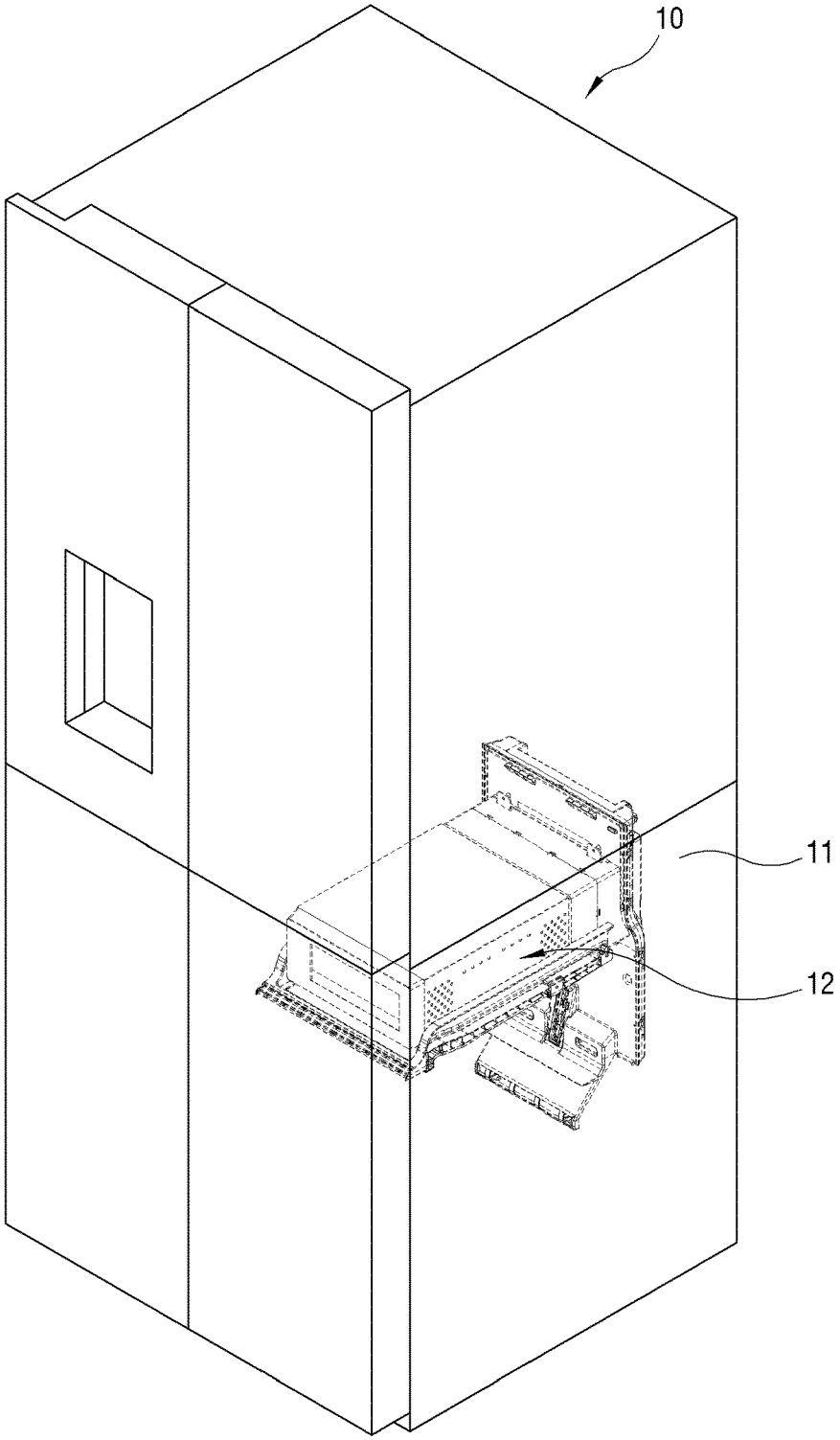
FIG. 1 is a perspective view schematically showing a refrigerator having a high frequency wave thawing device according to an embodiment.

FIG. 1 is a perspective view schematically showing a refrigerator having a high frequency wave thawing device according to an embodiment.

As shown in FIG. 1, the refrigerator 10 according to an embodiment is provided with a thawing part 12 in a freezer chamber 11 to provide a function, which thaws a material to be thawed accommodated in the freezer chamber 11. The refrigerator 10 according to an embodiment may be embodied as, for example, a general type, a double-door type, or a three or four-door type refrigerator, which is classified according to the number or opening way of doors. Also, the refrigerator 10 according to an embodiment may be embodied as, for example, an one-evaporator type, a two-evaporator type, or a three-evaporator type refrigerator, which is classified according to the number of evaporators for supplying cols air.

As described above, the refrigerator 10 according to an embodiment is not limited to many different structures or applications, and may be embodied as all kinds of refrigerators having the freezer chamber 11.

The refrigerator 10 according to an embodiment is provided with, along with the function of thawing the material to be thawed accommodated in the freezer chamber using the thawing part 12, a heat radiation or dissipation structure for effectively releasing heat generated when the thawing function is carried out using high frequency waves. Accordingly, in the refrigerator 10 according to an embodiment, a temperature of the freezer chamber 11 is not changed due to the heat generated when the thawing function is carried out using high frequency waves. As a result, the refrigerator 10 according to an embodiment does not spoil a food stored in the freezer chamber 11 due to the heat generated when carrying out the thawing function, and may prevent the function of the heat radiation structure from being deteriorated due to the heat.

Figure 2:
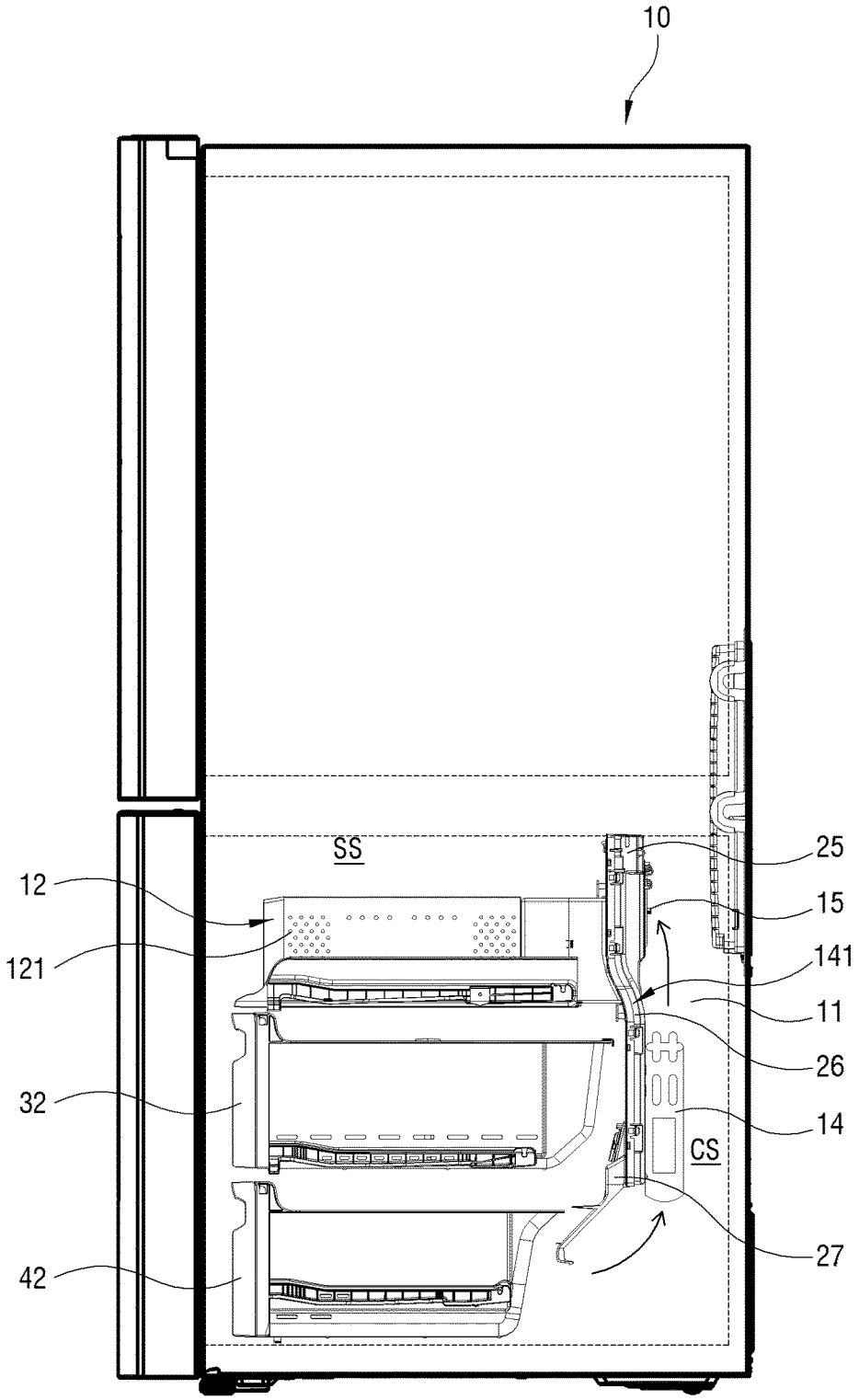
FIG. 2 is a side elevation view schematically showing a side of the refrigerator having the high frequency wave thawing device according to an embodiment.

FIG. 2 is a side elevation view schematically showing a side of the refrigerator having the high frequency wave thawing device according to an embodiment. As shown in FIG. 2, the freezer chamber 11 is divided into a cooling space CS, which is located in a rear thereof, and a storing space SS, which stores a material to be frozen, by a partition 141. The cooling space CS and the storing space SS are communicated with each other at lower parts thereof. A circulation fan 15 and an evaporator 14 are respectively installed on upper and lower parts of a surface of the partition 141 facing the cooling space CS. In the storing space SS are provided a lower thawing chamber 121 for thawing the material to be thawed, a middle storing chamber 32, and an upper storing chamber 42. The thawing chamber 121 is a portion of the thawing part 12 according to an embodiment.

The evaporator 14 cools an air of the cooling space CS. When an air, which has absorbed heat in the storing space SS, passes through the evaporator 14, the evaporator 14 generates a cold air through a heat exchange between the passing air and a refrigerant therein. The evaporator 14 includes an elongated tube (not shown) in which the refrigerant flows, and a plurality of pins (not shown) coupled with an outer circumference surface of the tube to allow the outer air to smoothly exchange the heat with the refrigerant flowing through the tube.

The circulation fan 15 performs a role, which transfers the cold air transmitted to an upper end of the evaporator 14 into the storing space SS.

The partition 141 has a circulation passage (see reference numeral 1416 in FIG. 14) in which the air flows. In the circulation passage 1416, an opening is provided on a position corresponding to the circulation fan 15, so that the cold air of the cooling space CS flows into the circulation passage 1416 by means of the circulation fan 15. The cold air, which flows into the circulation passage 1416, is discharged to the storing space SS through an upper outlet 25, a middle outlet 26 and a lower outlet 27. The cold air discharged to the storing space SS absorbs heat and then circulates to the cooling space CS via the lower part of the partition 141. The air moved into the cooling space CS with the heat included therein is again cooled by the evaporator 14, which absorbs the heat therefrom, and then flows into the circulation passage 1416 by means of the circulation fan 15.

Figure 3:
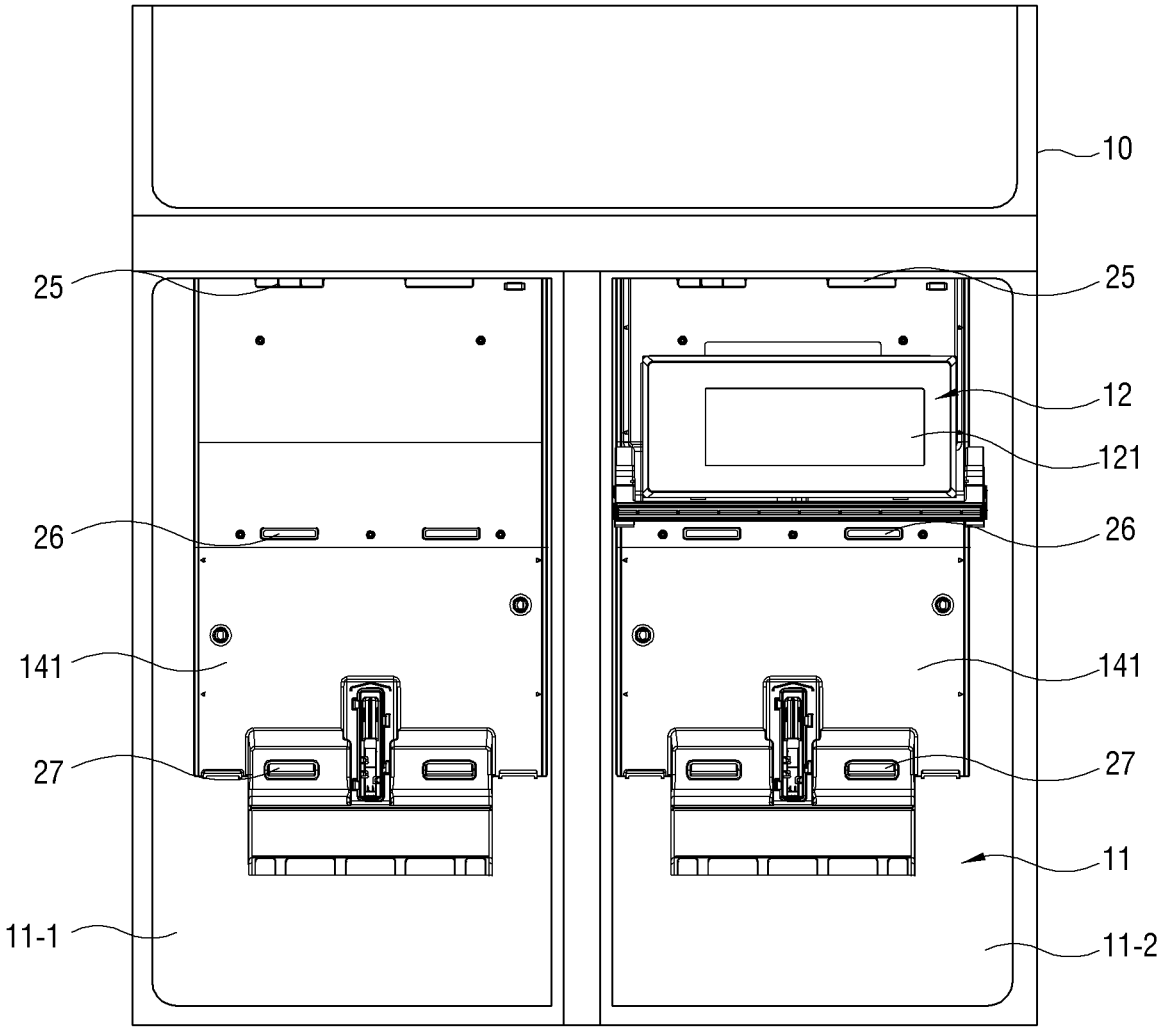
FIG. 3 is a front view showing an inside of a freezer chamber having the high frequency wave thawing device according to an embodiment.

FIG. 3 is a front view showing an inside of the freezer chamber 11 according to an embodiment. FIG. 3 shows a state from which a storing chamber for storing the material to be frozen is omitted. As shown in FIG. 3, the freezer chamber 11 includes a first freezer chamber 11-1 on the left thereof and a second freezer chamber 11-2 on the right thereof. The second freezer chamber 11-2 has with a thawing chamber 121 provided on an upper of the rear partition 141. The partition 141 is provided with the upper outlet 25, the middle outlet 26 and the lower outlet 27 to discharge the cold air. However, the number, the position and the like of the freezer chamber 11 and the thawing chamber 121 shown in FIG. 3 are only examples and the freezer chamber and the thawing chamber according to an embodiment may be embodied as many other numbers, positions and the like.

Figure 4:
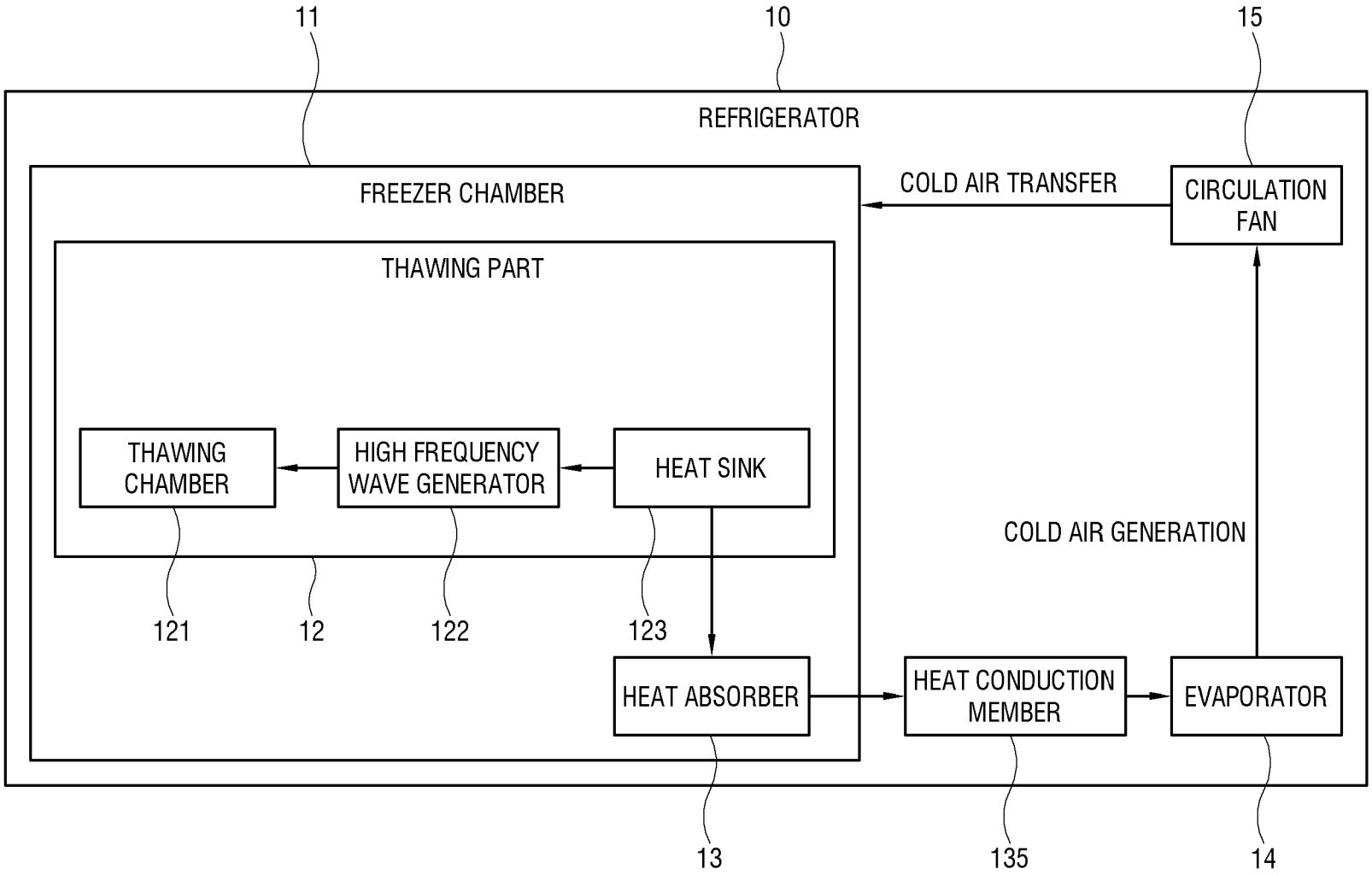
FIG. 4 is a block diagram showing a construction of the refrigerator having the high frequency wave thawing device according to an embodiment.

FIG. 4 is a block diagram showing the thawing part 12 and an radiation structure thereof according to an embodiment. The thawing part 12 according to an embodiment includes a thawing chamber 121, a high frequency wave generator 122, and a heat sink 123. Also, the refrigerator 10 includes a heat absorber 13 in the freezer chamber 11 in order to absorb heat of the thawing part 12. The thawing part 12 accommodates the material to be thawed therein and may selectively thaw the frozen material according to operations of the high frequency wave generator 122. The thawing chamber 121 may be provided with a plurality of holes having a given size to convey the cold air of the freezer chamber 11 thereinto in a freezing mode. Accordingly, the thawing chamber may receive the cold air of the freezer chamber 11 of which the temperature is maintained below a freezing point, as it is, thereby maintaining the frozen material in a frozen state. Shapes and sizes of the thawing chamber 121 are not limited to the embodiment, and may be differently applied according to sizes and models of the refrigerator 10.

The operation mode of the thawing chamber 121 may be switched to a freezing mode or a thawing mode according to user's inputs. For example, in the freezing mode, the thawing chamber 121 may freeze the material to be frozen in a predetermined temperature, and in the thawing mode, thaw the material to be thawed using high frequency waves generated in the high frequency wave generator 122.

The high frequency wave generator 122 is provided on a side of the thawing chamber 121 to generate the high frequency waves for thawing the material to be thawed. In the thawing mode, the high frequency wave generator 122 generates the high frequency waves, which radiates into the thawing chamber 121.

The heat sink 123 is attached to a rear surface of the high frequency wave generator 122 to absorb the heat generated when the high frequency wave generator generates the high frequency waves. Also, the refrigerator 10 further includes a heat conduction member 135, which conveys the heat absorbed by the heat absorber 13 to the evaporator 14.

As described above, the refrigerator 10 according to an embodiment may effectively cool the heat generated in the thawing part 12 using the basic circulation cooling composition including the evaporator 14, the circulation fan 15 and the like and the radiation composition of the thawing part 12 including the heat absorber 13, the heat conduction member 135 and the like.

Figure 5:
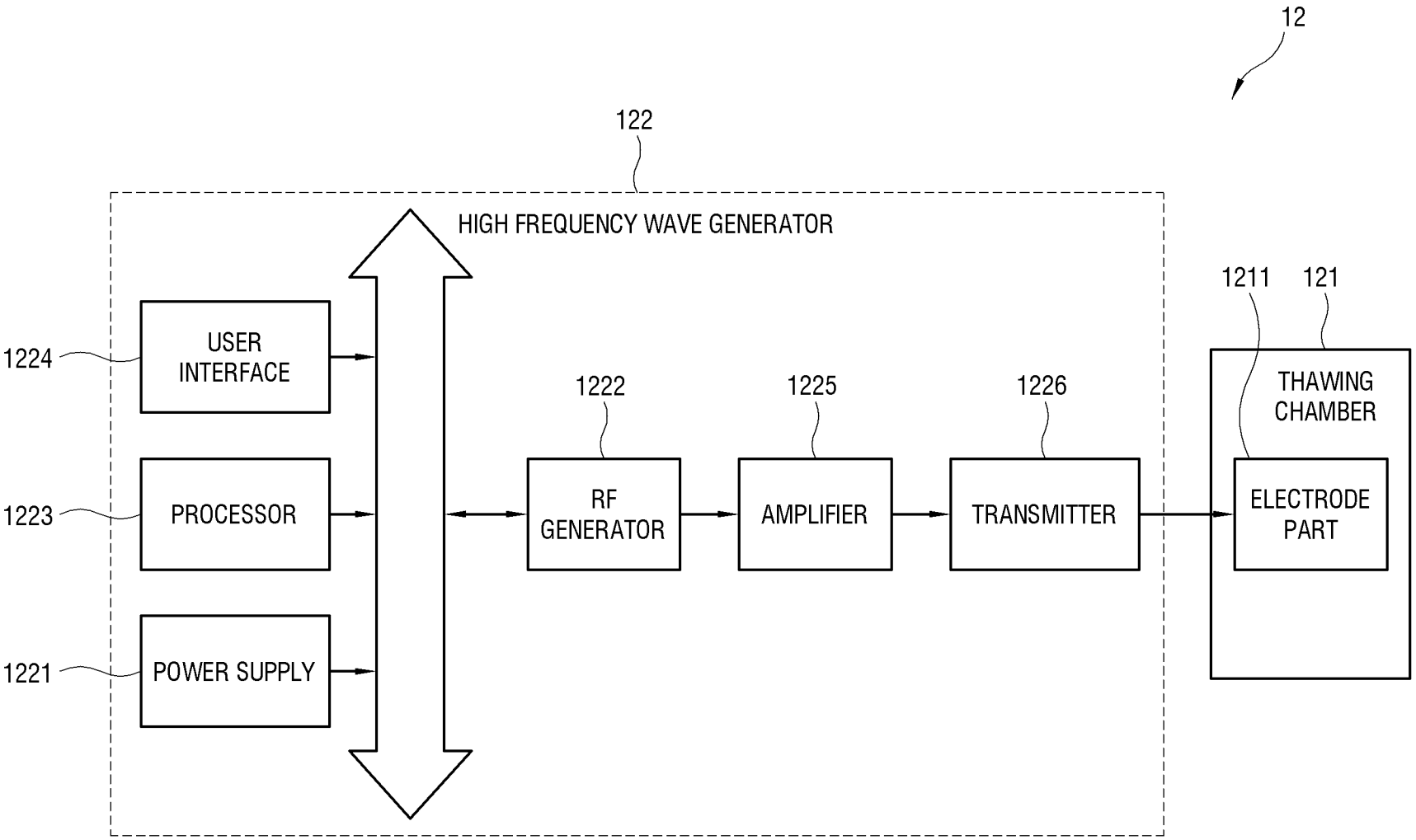
FIG. 5 is a block diagram of the high frequency wave thawing device according to an embodiment.

FIG. 5 is a block diagram showing a construction of the high frequency wave generator 122. As shown in FIG. 5, the high frequency wave generator 122, which is a circuit module required to generate the high frequency waves, includes a power supply 1221, a radio frequency (RF) generator 1222, a processor 1223, a user interface 1224, an amplifier 1225, and a transmitter 1226.

The power supply 1221 supplies power to the RF generator 1222 and the processor 1223. The power supply 1221 converts an alternating current (AC) power into a direct current (DC) power and supplies the converted DC power.

The RF generator 1222 generates high frequency waves (RF) for thawing the material to be thawed accommodated in the thawing chamber 121. The high frequency waves, which are electronic waves with high frequency, range from 30 Hz to 60 Hz. Here, the range of the high frequency waves used to thaw the material to be thawed is not limited to the embodiment and may be applied in varied extents taking account of a number of factors including a thawing time, a thawing method and the like.

The processor 1223, which is a controller, is embodied as at least one processor, which performs control operation to generate the high frequency waves. The processor 1223 controls operation for thawing the material to be thawed according to characteristics of the material to be thawed.

The processor 1223 controls to perform the thawing operation in response to user's inputs received via the user interface 1224. As an example, if a thawing time and a thawing temperature are set according to the user's inputs, the processor controls to perform the thawing operation to correspond to the set time and temperature conditions.

As another example, if the thawing mode are set as a 'porridge thaw', a 'frozen wonton thaw', or the like according to the user's inputs, the processor may control to perform a thawing operation suitable for characteristic of the material to be thawed according to the set mode.

The user interface 1224 is embodied as a circuit module for receiving the user's inputs. The user's inputs may be received from an input panel or a touch panel provided outside the refrigerator 10. Also, the user's inputs may be received from a remote controller for remotely controlling operations of the refrigerator 10. Here, the remote controller may be provided, for example, as a mobile device, such as a smart phone, in which an application for remote control is installed.

The amplifier 1225 amplifies the high frequency waves generated in the RF generator 1222.

The transmitter 1226 transmits the high frequency waves amplified in the amplifier 1225 to an electrode part 1211 via the transmitter 1226.

The thawing chamber 121 includes the electrode part 1211 in a space for accommodating the material to be thawed. The electrode part 1211 receives the high frequency waves transmitted in the transmitter 1226 to radiate to the material to be thawed.

As an embodiment, the refrigerator 10 further includes a communicator (not shown), and may receive, for example, commands for frozen function and thawing function from an external device, such as a smart phone or the like, via the communicator. For example, users may execute a refrigerator application in the smart phone to transmit a thawing start command or a thawing reservation command to the refrigerator 10. Like this, the refrigerator may control to perform the operation for thawing of the high frequency wave thawing device including the thawing part provided in the freezer chamber 11 via remote operations of the users in the smart phone or the like.

Figure 6:
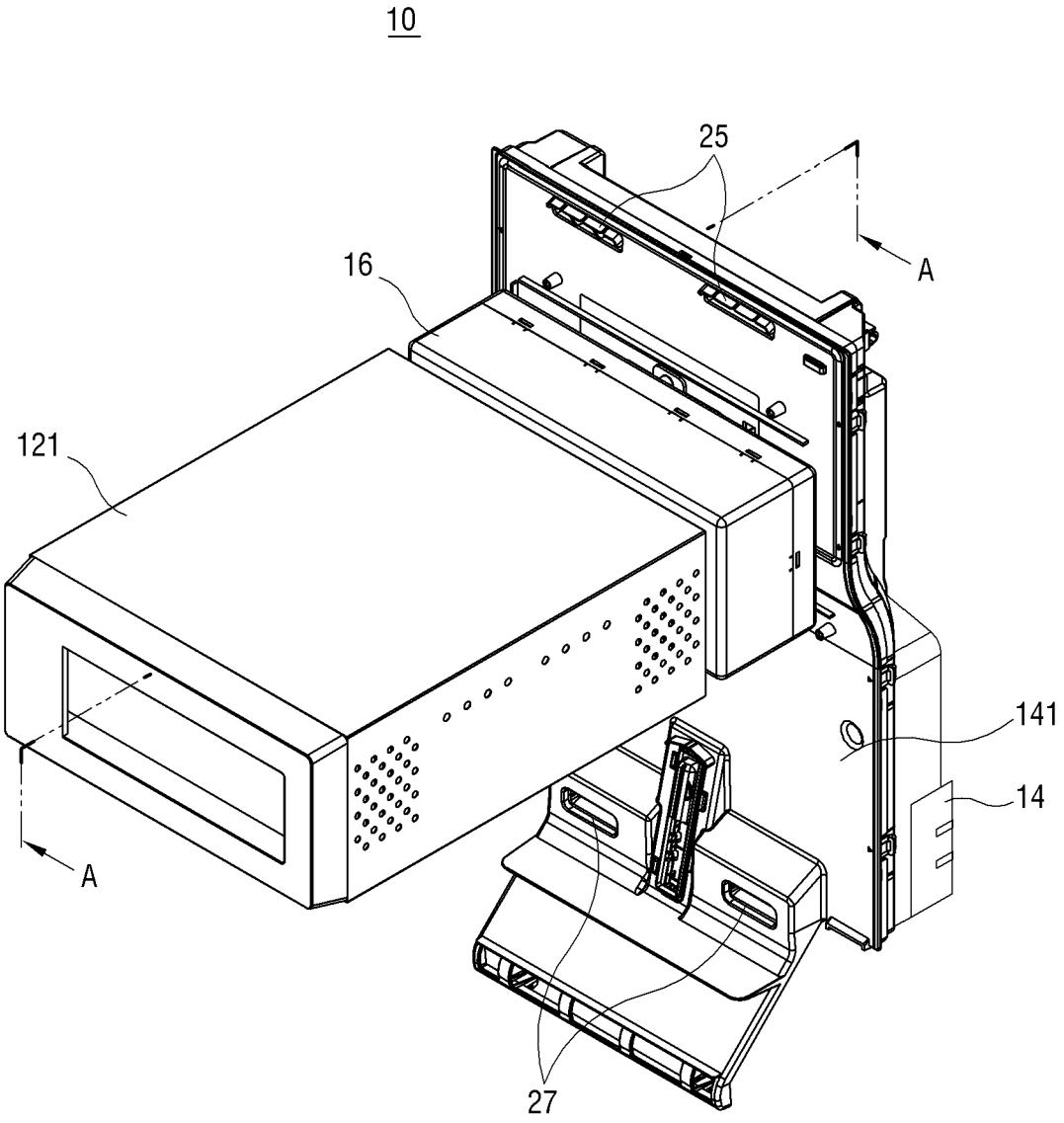
FIG. 6 is a perspective view showing a portion of the refrigerator having the high frequency wave thawing device according to an embodiment.
Figure 7:
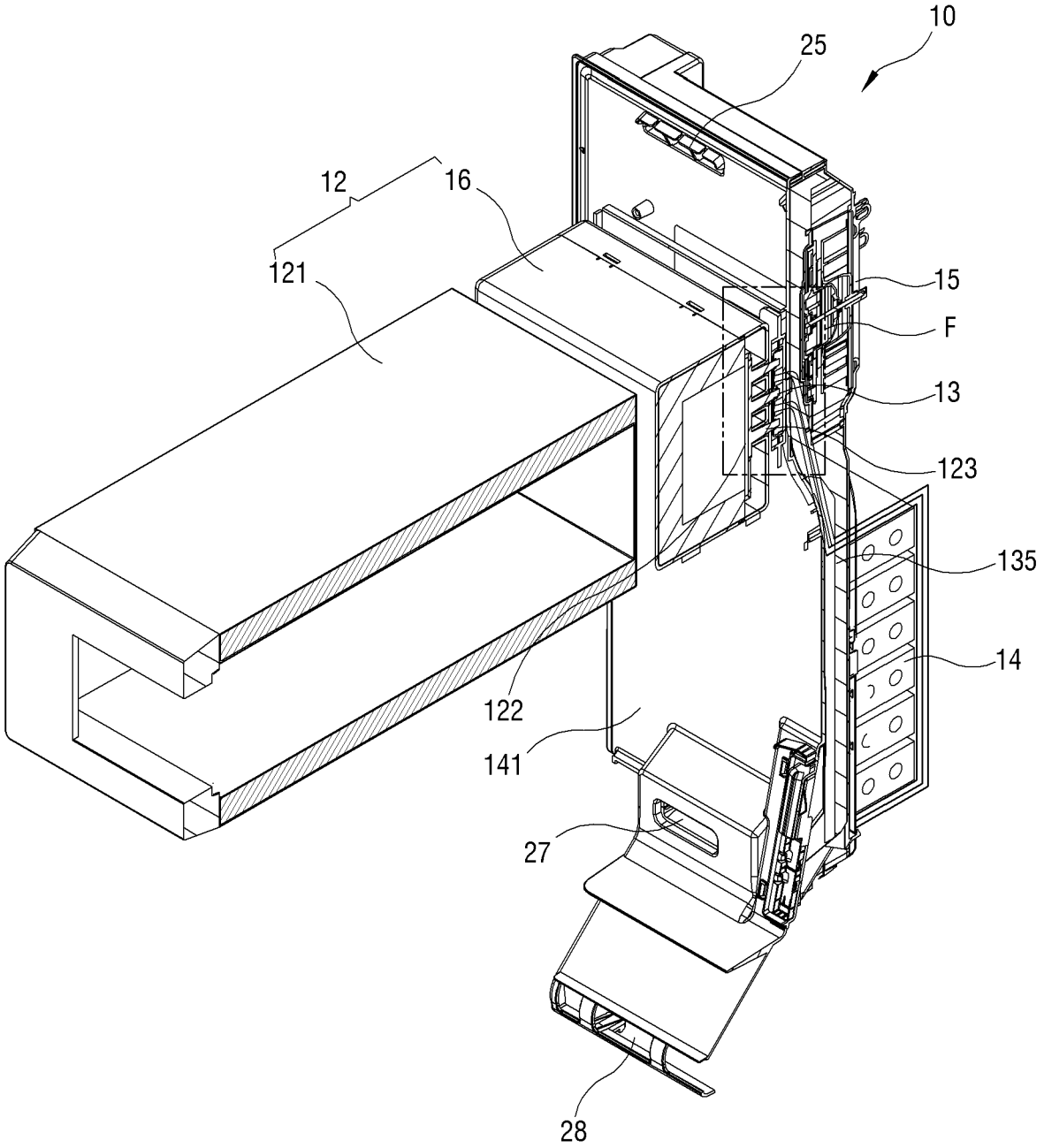
FIG. 7 is a perspective view showing a cross section taken along a line A-A of FIG. 6.
Figure 8:
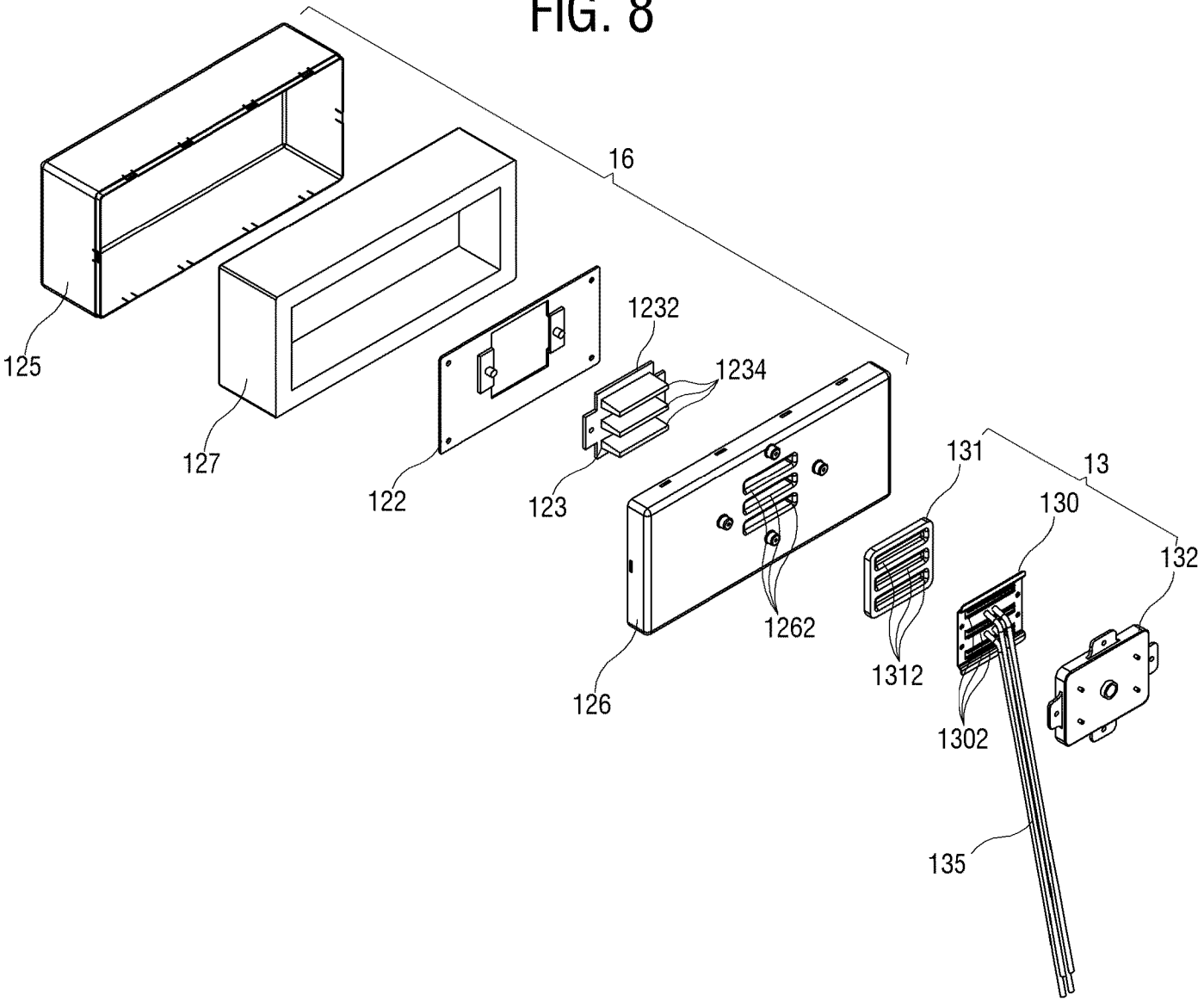
FIG. 8 is an exploded perspective view showing a construction of a device room and a heat absorber according to an embodiment.

FIG. 6 is a perspective view showing the thawing part 12 and the radiation construction thereof according to an embodiment, and FIG. 7 is a perspective view showing a cross section taken along a line A-A of FIG. 6. As shown in FIGS. 6 and 7, the thawing part 12 further includes a device room 16 coupled to a rear side of the thawing chamber 121. FIG. 8 is an exploded perspective view showing a construction of the device room 16 and the heat absorber according to an embodiment. As shown in FIG. 8, the device room 16 includes a device room casing 125, a device room cover 126, and an insulation member 127. The device room casing 125 is coupled with the device room cover 126 to form a space for accommodating the high frequency wave generator 122 and the heat sink 123 therein. The device room cover 126 covers an opened portion of the device room casing 125. The insulation member 127 is provided on an inner wall of the device room casing 125 to cut off the heat transfer to the freezing room 11. In other words, the insulation member 127 cuts off the heat generated when the high frequency wave generator 122 generates the high frequency waves, thereby keeping the inner temperature of the freezing room 11 from being affected by the generated heat.

The heat sink 123 is coupled to a rear surface of the high frequency wave generator 122 to absorb the heat generated in the high frequency wave generator 122. The heat sink 123 includes a substrate coupler 1232 configured to be attached to the high frequency wave generator 122, and a plurality of blades 1234 formed on a rear surface of the substrate coupler 1232. Although the plurality of blades 1234 shown in FIG. 8 includes three blades, the present disclosure is not limited thereto. The heat sink 123 may be composed of a metal, such as aluminum, having superior thermal transcalency.

In the device room cover 126 are provided three first blade passing holes 1262 through which the blades 1234 of the heat sink 123 pass. The blades 1234 of the heat sink 123 are protruded outside from the device room 16 through the first blade passing holes 1262.

The heat absorber 13 comes in contact with the heat sink 123 protruded from the device room 16 through the first blade passing holes 1262 thus to absorb the heat generated in the high frequency wave generator 122. Accordingly, the heat absorber 13 may absorb the heat, which is radiated from the heat sink 123, to radiate to the evaporator 14 via the heat conduction member 135. Of course, the heat absorber 13 may come in direct contact with the high frequency wave generator 122 thus to absorb the heat.

The heat absorber 13 includes a radiation plate 130, and a radiation plate casing 132 and a radiation plate cover 131, which are configured to accommodate the radiation plate 130.

The radiation plate 130 includes second blade passing holes 1302, which are able to accommodate the blades 1234 of the heat sink 123 and come in contact therewith. The blades 1234 of the heat sink 123 accommodated in the second blade passing holes 1302 transmits, to the radiation plate 130, the heat absorbed from the high frequency wave generator 122.

The radiation plate 130 transmits, to the heat conduction member 135, the heat transmitted from the heat sink 123. In stead of the second blade passing holes 1302, the radiation plate 130 may be embodied in a structure with protrusions (not shown) insertable between or separatable from the three blades 1234 of the heat sink 123.

The radiation plate cover 131 covers an opened portion of the radiation plate casing 132. The radiation plate cover 131 includes three third blade passing holes 1312 through which the blades 1234 of the heat sink 123 protruding from the device room cover 126 pass. Accordingly, the blades 1234 of the heat sink 123 pass through the third blade passing holes 1312 to be inserted into and come in contact with the second blade passing holes 1302 of the radiation plate 130.

The radiation plate casing 132 accommodates the radiation plate 130, so that in the radiation plate casing 132, the blades 1234 of the heat sink 123 are inserted into and come in contact with the second blade passing holes 1302 of the radiation plate 130.

Inside or outside the radiation plate casing 132 and the radiation plate cover may be provided an insulating material, which prevents the heat of the radiation plate 130 from being delivered to the freezer chamber 11.

The heat conduction member 135 at one end thereof is connected to the radiation plate 130 of the heat absorber 13 and at the other end thereof, the evaporator 14, more specific, an elongated tube (not shown) through which the refrigerant of the evaporator 14 flows or a plurality of pins (not shown) which allows the heat to be smoothly exchanged. At this time, the heat conduction member 135 may be connected with the tube or the pins, so that it surrounds the whole of the tube or the pins or partially winds the tube or the pins. Like this, the heat conduction member 135 receives the heat from the radiation plate 130 to deliver to the evaporator 14. The heat conduction member 135 may be embodied by a thermal conductor in the form of a wire, a plate, or other type, which is made of a metal with superior transcalency.

The heat conduction member 135 may be provided in the form of being buried in the partition 141. Here, the heat conduction member 135 at one end thereof and the other end thereof may be exposed out of the partition 141 and at the reminder thereof, buried in the partition 141.

Also, to prevent the heat from being transferred to surrounding structures, the heat conduction member 135 may be covered or coated with an insulation member with low heat conductivity.

Figure 9:
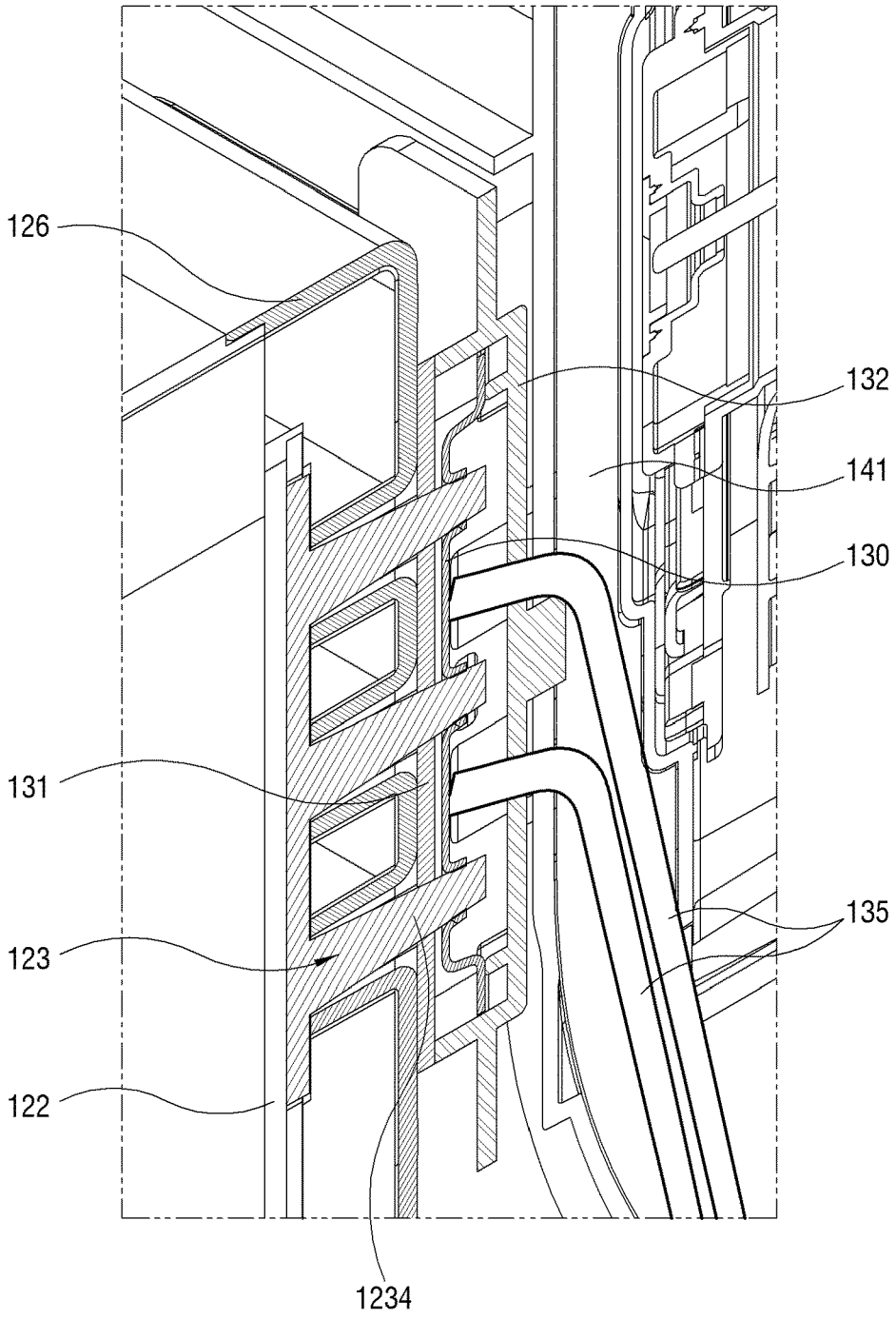
FIG. 9 is a view magnifying a portion F of FIG. 7.

FIG. 9 is a view magnifying a portion F of FIG. 7. As shown in FIG. 9, the blades 1234 of the heat sink 123, which is attached to the rear surface of the high frequency wave generator 122 in the device room 16, comes in contact to the radiation plate 130 in the radiation plate casing 132. The heat conduction member 135 at one end thereof comes in contact with the radiation plate 130 and at the other end thereof, is connected to the evaporator 14, as shown in FIG. 7. Types in which the heat absorber 13 comes in contact with the heat sink 123 are not limited to the embodiment and may be embodied in many different types and ways, which are capable of absorbing the heat from the heat sink 123.

As an embodiment, the heat absorber 13 may be embodied in such a form that it does not come in contact with the heat sink 123, but other construction of the high frequency wave generator 122, or it comes in direct contact with the high frequency wave generator 122 itself without the heat sink 123.

The heat generated from the high frequency wave generator 122 in the device room 16 is transferred to the heat sink 123, and the heat transferred to the heat sink 123 is absorbed into the radiation plate 130. The heat absorbed into the radiation plate 130 via the heat sink 123 as above is transferred to the evaporator 14 through the heat conduction member 135.

The evaporator 14 delivers the heat received through the heat conduction member 135, to the outside via the refrigerant. Like this, the heat generated in the high frequency wave generator 122 may be effectively released by the evaporator 14.

As described above, the refrigerator according to an embodiment may not only prevent the temperature of the freezer chamber 11 from being changed due to the heat generated in the high frequency wave generator 122 when it thaws the frozen food using the high frequency waves, but also prevent the high frequency wave generator 122 from being damaged due to the heat.

Figure 10:
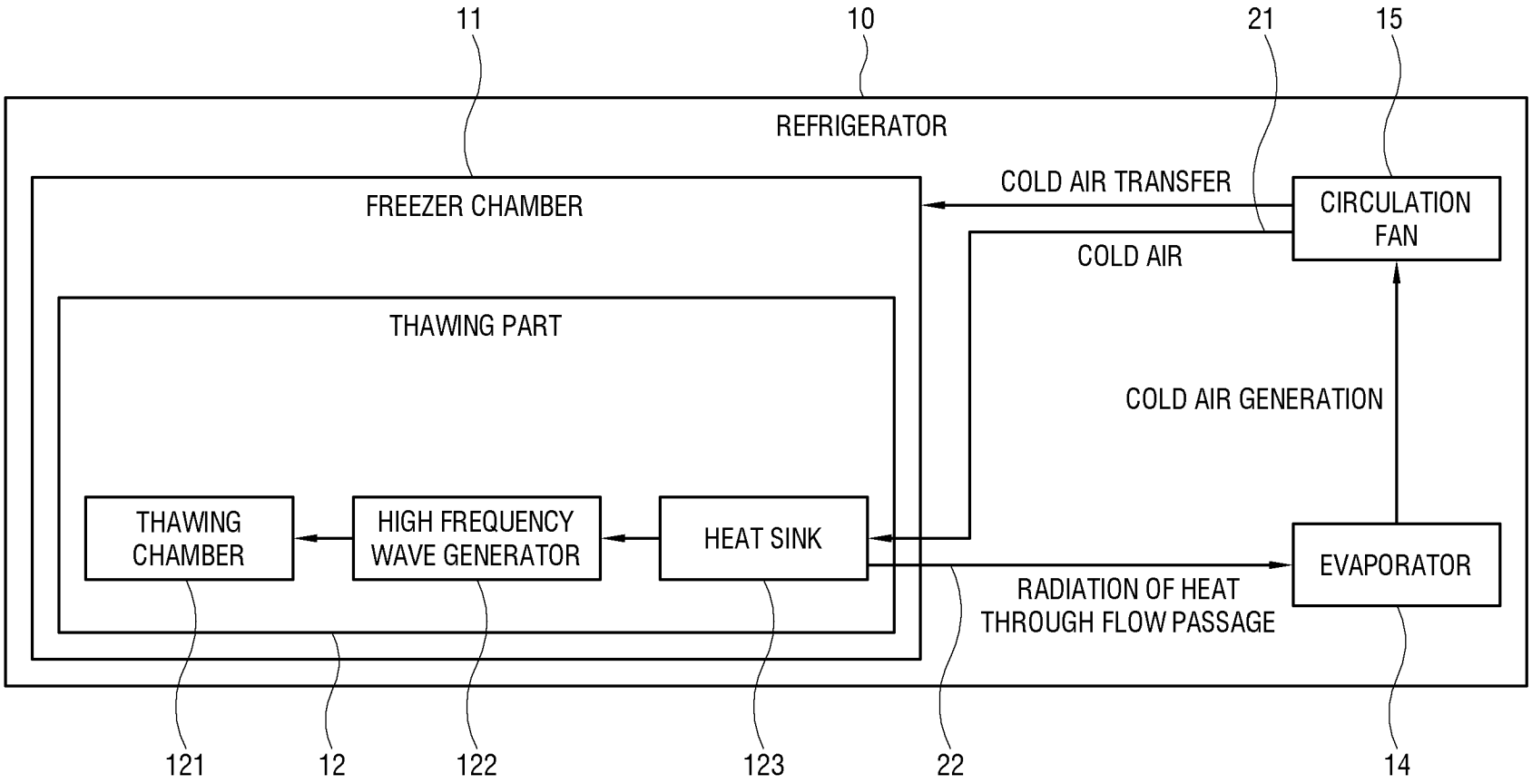
FIG. 10 a block diagram showing a construction of a refrigerator having a high frequency wave thawing device according to another embodiment.

FIG. 10 a block diagram showing a thawing part 12 and a radiation construction thereof according to another embodiment. Since the construction of the thawing part 12 according to another embodiment is the same as that of the thawing part 12 described with reference to FIGS. 4 to 9, detailed descriptions thereof will be omitted and only other constructions except that will be described In FIG. 10, the heat sink 123 is radiated by a cold air supplied through the circulation fan 15 and an incoming flow passage tube 21. The air, which absorbs heat by the heat sink 123, is delivered to a lower side of the evaporator 14 through an outgoing flow passage tube 22. The air supplied to the lower side of the evaporator 14 is joined with a circulation air for freezing the freezer chamber of the refrigerator 10, and then the heat among the air is absorbed by the evaporator 14. The cold air cooled by the evaporator 14 is supplied to the circulation fan 15 and then to the incoming flow passage tube 21 again. Like this, the heat generated in the high frequency wave generator 122 is absorbed by the heat sink 123, and the absorbed heat is released via the circulation cycle, which is composed of the outgoing flow passage tube 22, the evaporator 14, the circulation fan 15 and the incoming flow passage tube 21.

Figure 11:
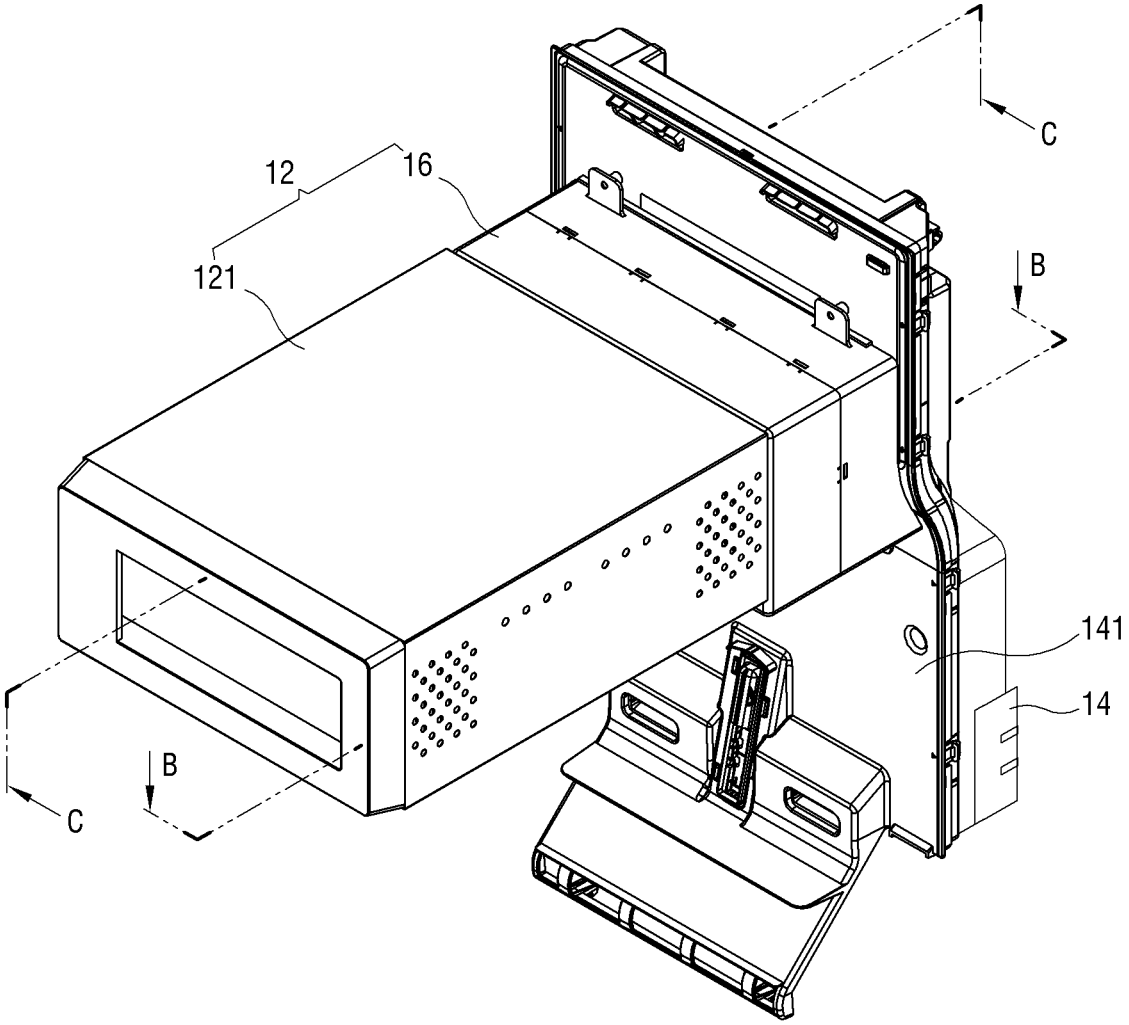
FIG. 11 is a perspective view showing a portion of the refrigerator having the high frequency wave thawing device according to another embodiment.

FIG. 11 is a perspective view showing the thawing part 12 and the radiation construction thereof according to another embodiment. As shown in FIG. 11, the thawing part 12 includes a device room 16 coupled to a rear side of a thawing chamber 121. Since a construction of the thawing chamber 121 is the same as that of the thawing chamber 121 shown with reference to FIGS. 4 to 9, detailed descriptions thereof will be omitted.

Figure 12:
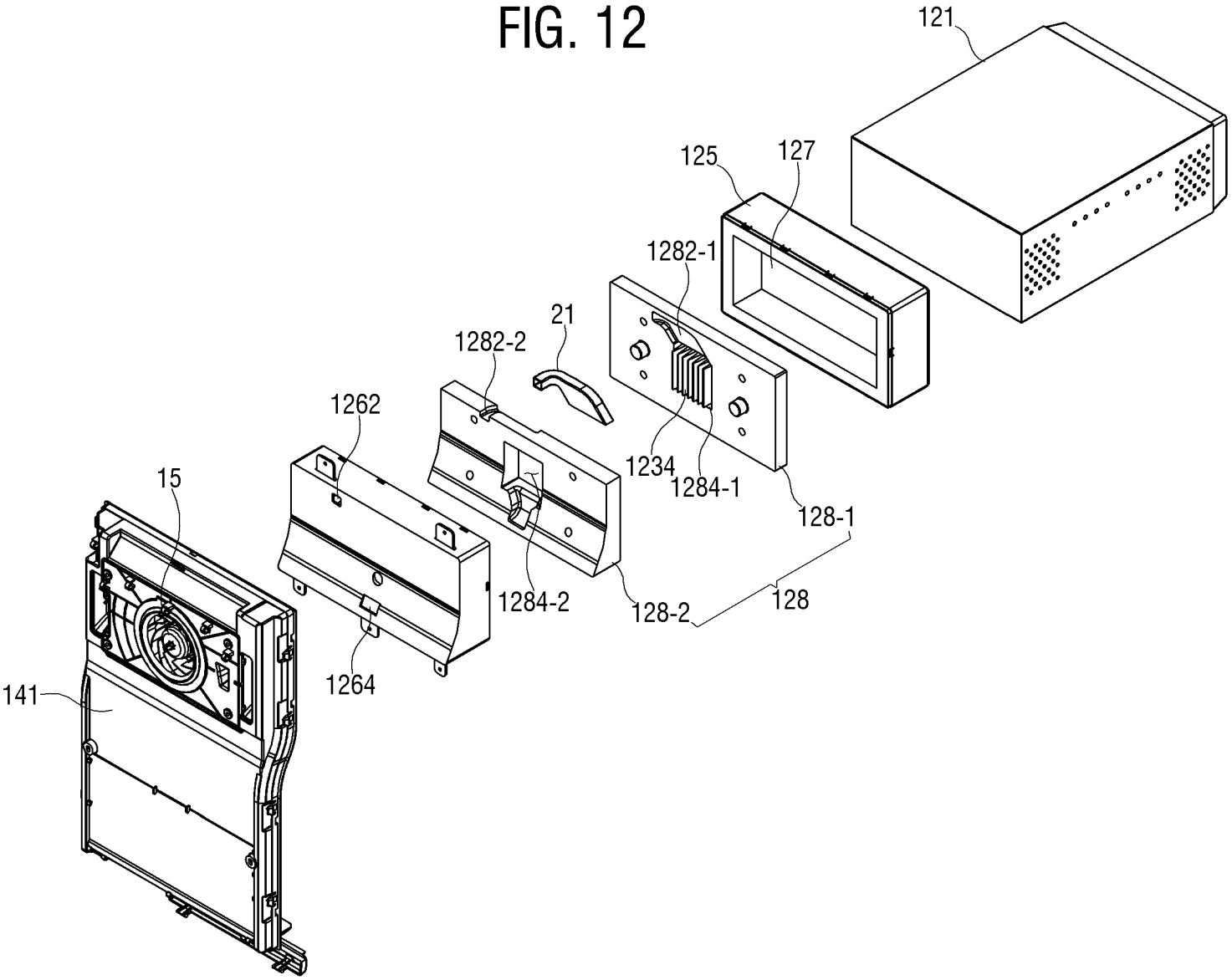
FIGS. 12 and 13 are exploded perspective views showing a radiation structure according to another embodiment.
Figure 14:
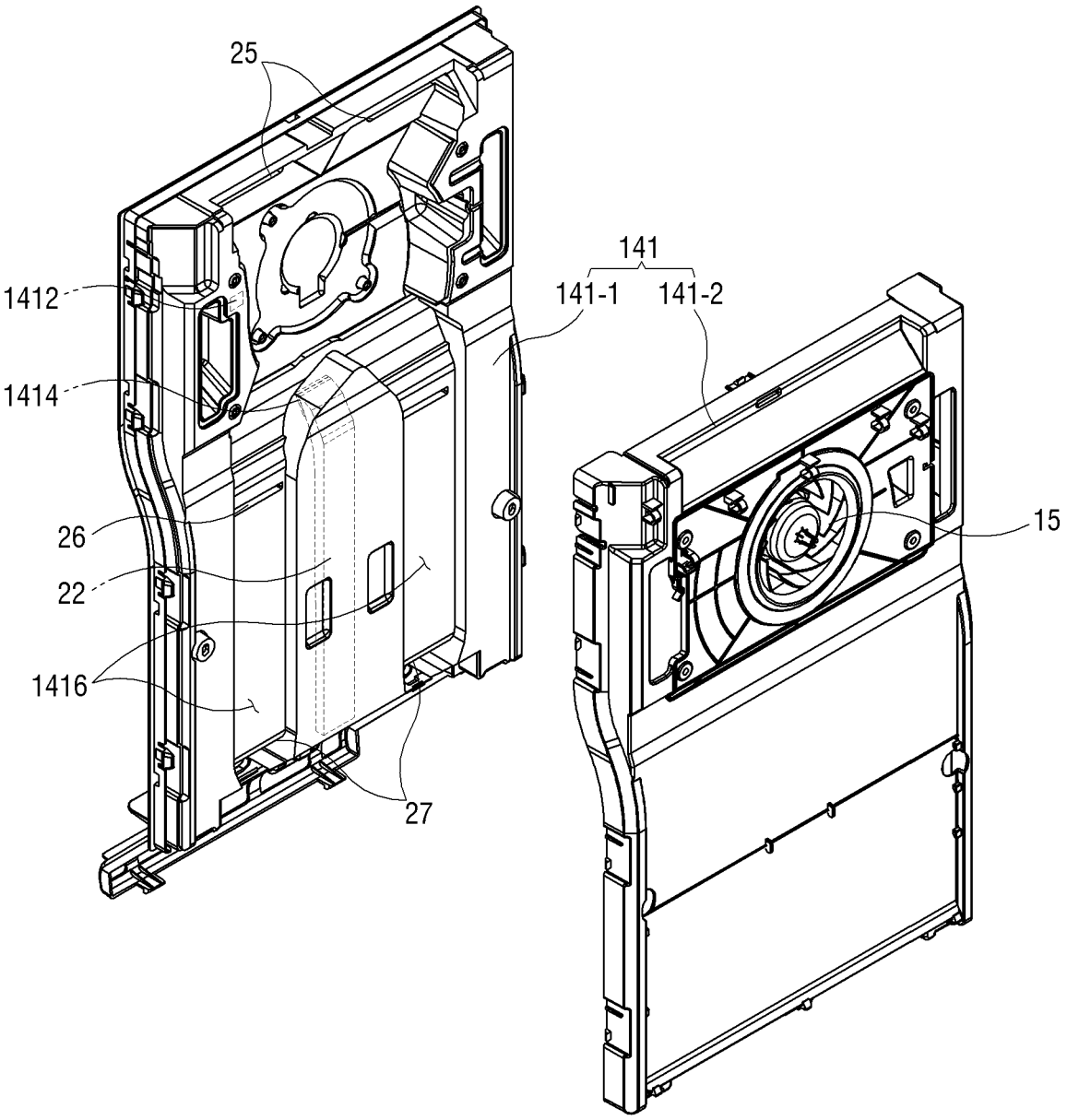
FIG. 14 is a perspective view showing an air outgoing flow passage of the heat radiation structure according to another embodiment.

FIGS. 12 and 14 are exploded perspective views showing the device room 16 and the radiation construction related thereto shown in FIG. 11. The device room 16 includes a device room casing 125 to form a first space, a device room cover 126 to form a second space, an insulation member 127, and a radiation block 128. Since constructions of the heat sink 123 and the high frequency wave generator 122 are the same as those shown in FIGS. 4 to 9, detailed descriptions thereof will be omitted.

The high frequency wave generator 122 may be embodied as a substrate (not shown) on which a plurality of electronic circuit parts (not shown) is mounted, and the substrate is interposed between the first space and the second space and the electronic circuit parts are disposed facing the first space.

The heat sink 123 is attached to the high frequency wave generator 122 and disposed in the second space.

The device room casing 125 is formed in a box form to form the first space in which the high frequency waves are radiated.

The device room cover 126 forms the second space to absorb the heat generated in the high frequency wave generator 122, and has the radiation block 128 provided therein. The device room cover 126 includes a cold air inlet 1262 into which cold air flows at a portion thereof coming in contact with the partition 141, and an air outlet 1264 through which air with heat absorbed in the radiation block 128 is discharged.

The insulation member 127 is embodied in a box form with a material with low heat conductivity, and provided in the first space of the device room casing 125 to block the heat exchange with the freezer chamber 11.

The radiation block 128 is provided in the device room cover 126 to cool the heat sink 123, which absorbs the heat from the high frequency wave generator 122. The radiation block 128 includes a first radiation block 128-1 and a second radiation block 128-2. The first radiation block 128-1 shuts down the first space formed by the device room casing 125 and the insulation member 127. The second radiation block 128-2 at one side thereof is coupled with the first radiation block 128-1 and at the other side thereof, comes in contact with an inner wall of the device room cover 126

The first radiation block 128-1 includes a first passage tube receiver 1282-1, which accommodates a portion of an incoming flow passage tube 21 to be described later, and a first heat sink receiver 1284-1, which accommodates a portion of the blades 1234 of the heat sink 123.

The second radiation block 128-2 includes a second passage tube receiver 1282-2, which accommodates the remainder of the incoming flow passage tube 21 to be described later, and a second heat sink receiver 1284-2, which accommodates the reminder of the blades 1234 of the heat sink 123.

The radiation block 128 is preferably formed of a material with low heat conductivity to prevent the heat exchange with the freezer chamber 11.

The radiation block 128 includes the incoming flow passage tube 21 through which the cold air supplied from the circulation fan 15 flows in.

An inlet (reference numeral 212 in FIG. 15) of the incoming flow passage tube 21 is disposed to correspond to an air outlet 1412 of the partition 141. An air outlet 1264 of the device room cover 126 is disposed to correspond to an air inlet 1414 of the partition 141. Also, In the partition 141 is further formed an outgoing flow passage tube 22, which is connected with the air inlet 1414 to be described later.

As shown in FIG. 14, the partition 141 includes a front partition 141-1 adjacent to the freezer chamber 11, and a rear partition 141-2 coupled to a rear surface of the front partition 141-1. In the front partition 141-1 is formed an outgoing flow passage tube 22, which is extended downwards from an air inlet 1414 of the front partition 141-1. Further, in the rear surface of the front partition 141-1 is formed a circulation passage 1416 in which the cold air supplied by the circulation fan 15 flows. Also, in the front partition 141-1 is formed an air outlet 1412 through which the cold air supplied by the circulation fan 15 is discharged. The air discharged to the air outlet 1412 flows into an incoming flow passage tube 21 via the cold air inlet 1262 of the device room cover 126. On the other hand, in the front partition 141-1 are formed an upper outlet 25, a middle outlet 26 and a lower outlet through which the cold air flowing through the circulation passage 1416 is discharged to an upper portion, a middle portion and a lower portion of the freezer chamber 11, respectively.

Figure 15:
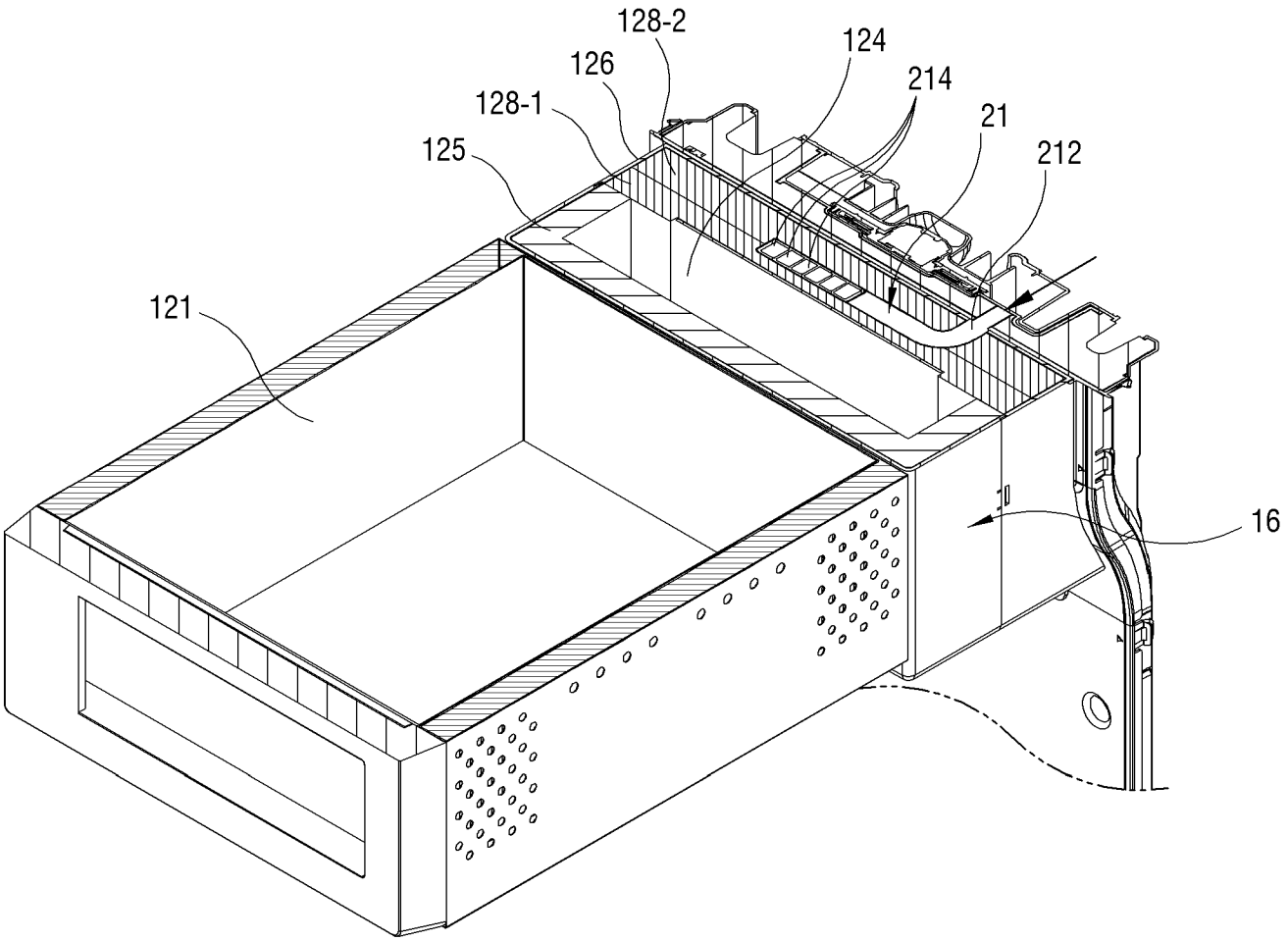
FIG. 15 is a perspective view showing a cross section taken along according to a line B-B of FIG. 11.
Figure 16:
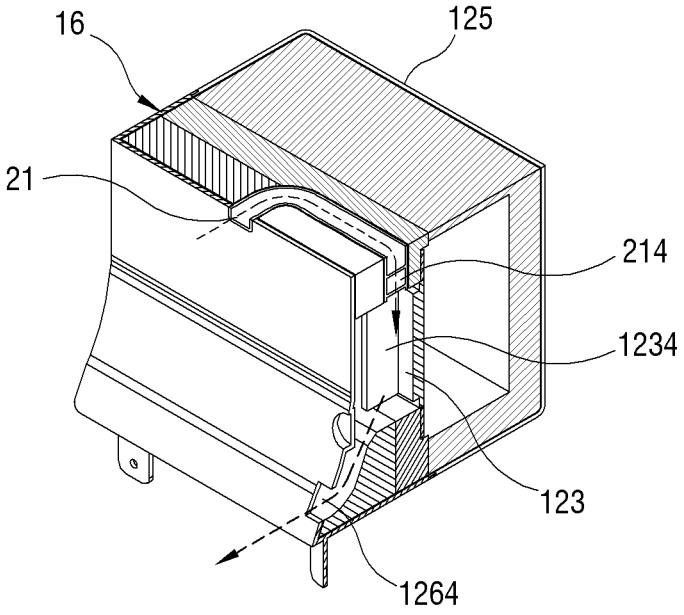
FIG. 16 is a perspective view showing an heat radiation flow passage according to another embodiment.
Figure 17:
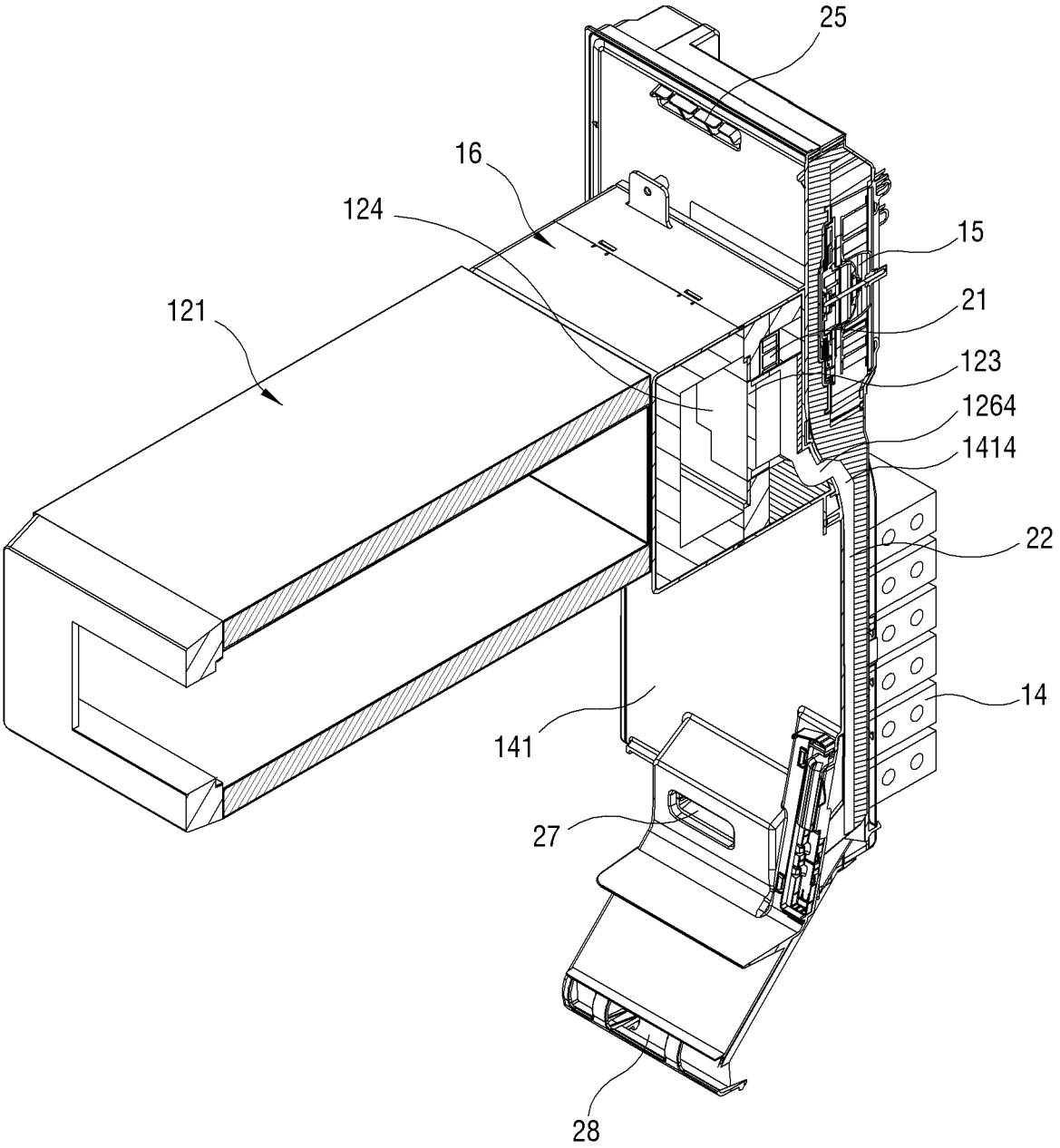
FIG. 17 is a perspective view showing a cross section taken along according to a line C-C of FIG. 11.

FIG. 15 is a perspective view showing a cross section taken along according to a line B-B of FIG. 11, FIG. 16 is a perspective view showing a cross section taken along according to the line B-B and a line C-C of FIG. 11 in a direction opposite to that of FIG. 15, and FIG. 17 is a perspective view showing a cross section taken along according to a line C-C of FIG. 11.

As shown in FIGS. 15 and 16, the incoming flow passage tube 21 is configured in a form having one inlet 212 and a plurality of outlets 214. The outlets 214 of the incoming flow passage tube 21 are disposed adjacent to the blades 1234 of the heat sink 123.

Figure 13:
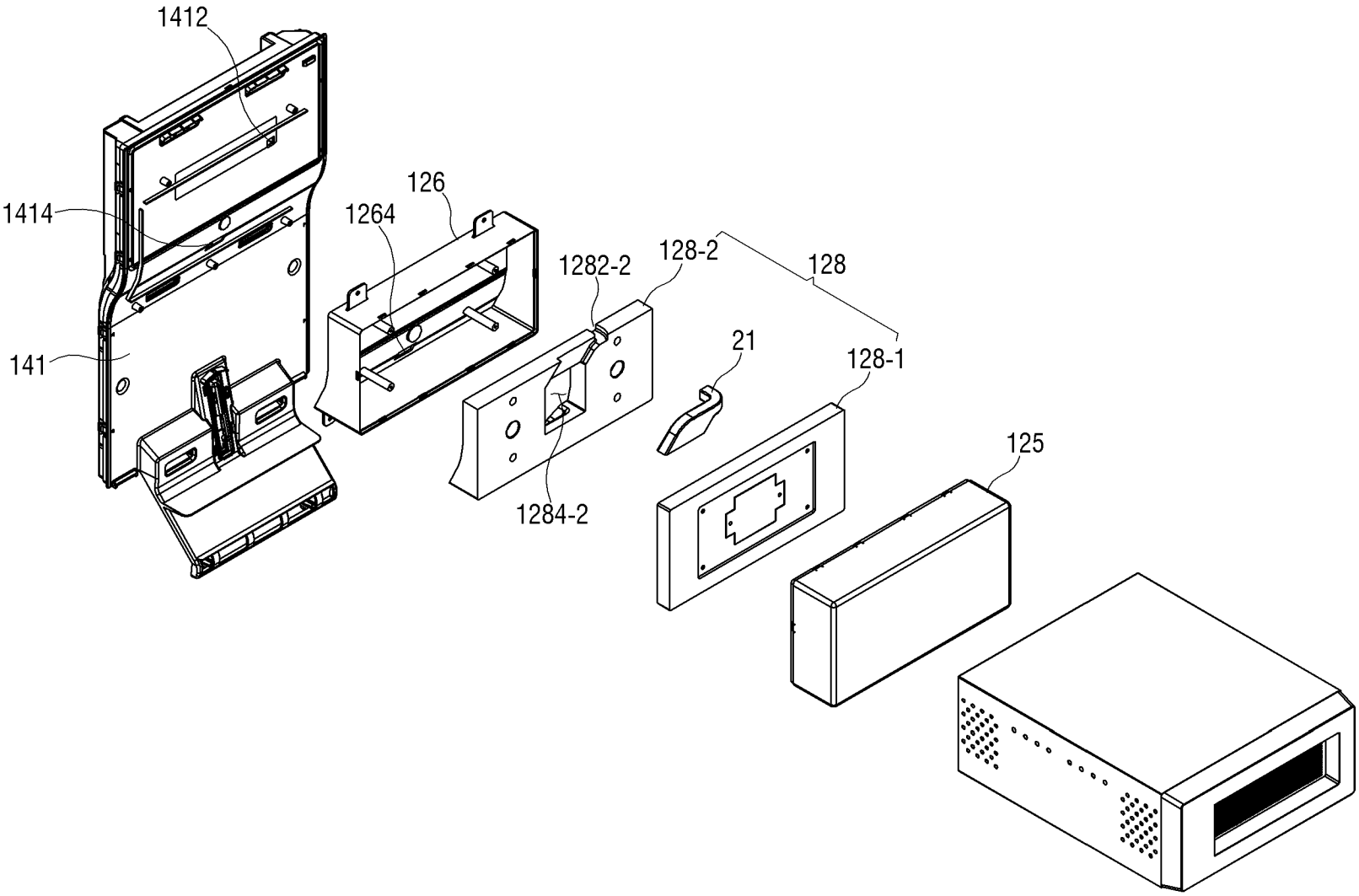

The cold air supplied by the circulation fan flows in through the inlet 212 of the incoming flow passage tube 21 via the cold inlet (reference numeral 1263 in FIG. 13) of the device room cover 126, and is then discharged to the plurality of outlets 214.

As shown in FIG. 16, the cold air discharged through the outlets 214 of the incoming flow passage tube 21 passes through between the blades 1234 of the heat sink 123 to absorb the heat, and is then discharged through the air outlet 1264 of the device room cover 126.

As shown in FIG. 17, the air discharged through the air outlet 1264 flows into the air inlet 1414 of the partition 141 and is discharged down through the outgoing flow passage tube 22. The air discharged to a lower portion of the partition 141 is joined with the circulating air in the freezer chamber 11, and moves toward the evaporator 13 to be cooled therethrough. The cold air cooled in the evaporator 13 as above is circulated flowing into the air outlet 1412 again.

In the refrigerator 10 according to the embodiment as described above, the circulation passage for releasing the heat of the heat sink 123, i.e., the circulation passage composed of the heat sink 123, the outgoing flow passage tube 22, the evaporator 14, the circulation fan 15 and the incoming flow passage tube 21 is only an example for explanation, and may be modified and applied in many different types.

Although a few embodiments have been described in detail, the present disclosure is not limited to these embodiments and various changes may be made without departing from the scope defined in the appended claims.

The invention claimed is:

1. A refrigerator comprising:

a freezer chamber comprising a partition configured to divide a storing space for accommodating a material to be thawed therein and a cooling space for cooling air therein, a thawing chamber arranged in the storing space, and a device room arranged between the partition and the thawing chamber and having an insulated inner wall;

an evaporator arranged in the cooling space to generate a cold air through a heat exchange;

a circulation fan arranged in the cooling space to transmit, to the freezer chamber, the cold air generated by the evaporator;

a high frequency wave generator arranged in the device room at one side of the thawing chamber to generate high frequency waves in order to thaw a material to be thawed accommodated in the thawing chamber;

a heat absorber attached to the high frequency wave generator between the device room and the partition to absorb heat from the high frequency wave generator; and a heat conduction member connected between the heat absorber and the evaporator to transfer heat from the heat absorber to the evaporator.

2. The refrigerator according to claim 1, further comprising:

a heat sink attached to the high frequency wave generator to absorb heat generated when the high frequency wave generator generates the high frequency waves, between the high frequency wave generator and the heat absorber.

3. The refrigerator according to claim 2, wherein the heat absorber comprises a radiation plate detachably attached to the heat sink, and a radiation plate casing and a radiation plate cover configured to accommodate the radiation plate therein, and wherein the radiation plate is configured to radiate heat transferred from the heat sink.

4. The refrigerator according to claim 3, wherein the radiation plate casing and the radiation plate cover comprises an insulation member to prevent the radiation plate from exchanging heat with the freezer chamber.

5. The refrigerator according to claim 2, wherein the high frequency wave generator comprises:

a power supply configured to supply power;

a radio frequency (RF) generator configured to generate the high frequency waves for thawing the material to be thawed accommodated in the thawing chamber; and a processor configured to control an operation for thawing according to characteristics of the material to be thawed.

6. The refrigerator according to claim 5, wherein the processor is configured to receive a user input through a user interface and control to carry out an operation for thawing corresponding to the received user input.

7. The refrigerator according to claim 5, wherein the thawing chamber comprises an electrode part configured to receive the high frequency waves generated in the RF generator to radiate to the material to be thawed.

8. The refrigerator according to claim 1, further comprising:

a device room provided with the high frequency wave generator therein, wherein the device room comprises an insulation member to prevent from exchanging heat with the freezer chamber.

9. The refrigerator according to claim 1, wherein the thawing chamber is configured to switch between a freezing mode and a thawing mode according to the user input.

10. The refrigerator according to claim 1, wherein the freezer chamber comprises a partition configured to divide a storing space for accommodating the material to be thawed and a cooling space for cooling air therein, and wherein the partition is configured to form a flow passage of cold air through which the air cooled in the cooling space is transferred to the storing space.

11. A refrigerator comprising:

a freezer chamber comprising a partition configured to divide a storing space for accommodating a material to be thawed therein and a cooling space for cooling air therein, having a thawing chamber arranged in the storing space, and a device room arranged between the partition and the thawing chamber and having an insulated inner wall;

an evaporator arranged in the cooling space to generate a cold air through a heat exchange, on an outside of the partition;

a circulation fan arranged in the cooling space to transmit, to the freezer chamber, the cold air generated by the evaporator;

a high frequency wave generator arranged in the device room at one side of the thawing chamber to generate high frequency waves in order to thaw a material to be thawed accommodated in the thawing chamber;

a heat absorber attached to the high frequency wave generator in the device room to absorb heat from the high frequency wave generator; and a flow passage configured to transmit the cold air generated by the evaporator to the heat absorber through the partition from the evaporator, and transfer the heat absorbed by the heat absorber to the evaporator through the partition.

12. The refrigerator according to claim 11, wherein the device room comprises a first space configured to accommodate the high frequency wave generator therein and a second space configured to cool the heat generated in the high frequency wave generator, and wherein the flow passage is provided to move air in the second space to the evaporator.

13. The refrigerator according to claim 12, wherein the heat absorber comprises a heat sink attached to the high frequency wave generator to absorb heat generated when the high frequency wave generator generates the high frequency waves in the second space.

14. The refrigerator according to claim 13, wherein the insulated inner wall comprises an insulation member configured to prevent from exchanging heat with the freezer chamber in the first space and the second space.

15. The refrigerator according to claim 11, wherein the flow passage comprises:

an incoming flow passage tube configured to provide the cold air supplied from the evaporator to the heat absorber; and an outgoing flow passage tube configured to flow out the heat absorbed by the heat absorber to the evaporator.

* * * * *